United States Patent [19]

Ackerson, III

[11] Patent Number: 4,532,831

[45] Date of Patent: Aug. 6, 1985

[54] METHOD OF AND APPARATUS FOR OPENING CONTAINER LIDS

[76] Inventor: Arthur O. Ackerson, III, 33 Boulder Dr., Bay Point, Key West, Fla. 33040

[21] Appl. No.: 647,467

[22] Filed: Sep. 5, 1984

[51] Int. Cl.[3] ..... B67B 7/22

[52] U.S. Cl. ..... 81/3.43; 81/3.57

[58] Field of Search ..... 81/3.46 A, 3.43, 3.34, 81/3.4; 29/239, 426.5

[56] References Cited

U.S. PATENT DOCUMENTS

| | | | |
|---|---|---|---|
| 1,279,441 | 9/1918 | Relyea | 81/3.46 A |
| 1,350,180 | 8/1920 | Relyea | 81/3.46 A |
| 1,357,914 | 11/1920 | Tower | 81/3.46 A |
| 1,389,818 | 9/1921 | Dearing | 81/3.43 |
| 1,450,168 | 4/1923 | Beyer | 81/3.43 |
| 2,013,209 | 9/1935 | Hargreaves | 81/3.43 |
| 2,458,393 | 1/1949 | Loudfoot | 81/3.43 |

FOREIGN PATENT DOCUMENTS

| | | | |
|---|---|---|---|
| 324764 | 9/1920 | Fed. Rep. of Germany | 81/3.43 |
| 339072 | 7/1921 | Fed. Rep. of Germany | 81/3.43 |
| 149077 | 11/1931 | Switzerland | 81/3.43 |

*Primary Examiner*—Roscoe V. Parker

*Attorney, Agent, or Firm*—Lowe King Price & Becker

[57] ABSTRACT

An apparatus (20) for opening a container (42) comprises a cord (22) looped at one end of a cylindrical member (24) and having a free end (28) that extends through the member and a transverse gripper (26). One end (36) of the cord is anchored to the wall of the cylindrical member (24), and the free end is saddled within a notch (38) formed in the gripper. The cord (22) is formed of a nylon wrap or other material that has a "rebound" characteristic, that is, wherein the cord has a diameter that reduces as the cord is stretched and rebounds as the cord is released. In use, the cord loop (44) is wrapped around the gap formed between the lid (40) and container (42). The cord (22) is manually twisted, and as the cord stretches, its diameter reduces until the cord slips into the gap. As the cord (22) is further twisted within the gap, it tends to flatten against the neck of the lid (40) thereby imparting an axial separating force to the lid and container. Following separation, the cord (22) rebounds to its normal shape. Adapter rings (46) and (48) establish a gap if none is provided by the structure of cover (40) and container (42).

6 Claims, 11 Drawing Figures

METHOD OF AND APPARATUS FOR OPENING CONTAINER LIDS

TECHNICAL FIELD

This invention relates generally to apparatus and methods for opening containers, and more particularly, toward an apparatus and method using a cord positioned within the gap between a lid and container to separate the two axially without damaging contact surfaces.

BACKGROUND ART

Closed containers, particularly rigid or semi-rigid glass laboratory bottles or flasks with straight or tapered internal neck plugs, caps or stoppers, generally have a seal, sometimes caused by atmospheric pressure or may otherwise be frozen or jammed. This makes the containers difficult to open, and forcing the lid and container apart tends to damage the glass or other material forming the components.

Various techniques and apparatus have been used in the past to unseal or force open jammed containers with limited success. Apparatus which require rotation of the lid or cover on the container to break the seal have a tendency to damage the neck of the container, particularly when the seal is especially tight. Furthermore, some container-opening apparatus are designed only for specific types of containers and lids, particularly glass jars with rubber gaskets, often used in home food preservation.

For example, U.S. Pat. Nos. 1,450,168; 1,350,180; 1,279,441; and 1,357,914 disclose implements for removing lids from glass jars. Each of the implements comprises a loop of flexible wire attached to a handle. The loop is placed between the jar and lid, and the handle to which the loop is secured is used as a lever against the neck of the container to force or wedge the wire loop into the seal to thereby break it. In U.S. Pat. No. 1,389,818 a jar opener comprises a wire loop, secured to two handles with one of each handle pivotally attached to a metal disk. The ends of the wire loop are connected to the handles on opposite sides of a pivot pin. The handles are pivoted to be diametrically opposed to each other, thereby forcing the wire loop into the seal between the container lid and the container.

U.S. Pat. No. 2,458,393 discloses an implement for turning threaded container lids, comprising a handle attached to a loop of frictional cord to encircle the container lid. The cord is imparted with a pushing, circular motion in the direction in which it is desired to turn the lid.

In U.S. Pat. No. 2,013,209 a cable serving as a grip for a cap, is clamped to a handle by a suitable lever. A continuous tilting movement of the handle loosens the cap from the mouth of the jar.

Thus, in the prior art, leveraged pressure has been applied against the neck of a container or a container lid to force open any seal between the two. A danger inherent in this kind of mechanism is in damage to the container, lid or both.

DISCLOSURE OF THE INVENTION

It is accordingly one object of the invention to provide an apparatus and method for opening container lids, whereby the lid is lifted rather than rotated relative to the container.

It is another object to provide an apparatus and method for opening container lids, whereby the container is not rotated.

Yet another object is to provide an apparatus and method for opening container lids adaptable for different lid shapes.

Still a further object is to provide an efficient, inexpensive and simple method and apparatus for opening container lids.

In accordance with the invention, an apparatus for opening container lids comprises a cord looped at one end of a solid cylindrical member and extending through a pair of longitudinal bores in the cylinder. One end of the cord extending in one of the bores is anchored at the cylinder wall; the opposite end extends through the other bore out the opposite end of the cylinder. A transverse gripper attached to the cylinder contains a notched end for receiving the free end of the cord. The cord is formed of wound nylon or other material having a "rebound" characteristic whereby the diameter of the cord decreases when the cord is stretched and rebounds when released.

To open a container, the cord loop at one end of the cylindrical member is positioned in the gap between the lid and container, and the free end of the cord is adjusted so that the diameter of the loop is slightly greater than the diameter of the lid. Using the gripper, the cord is now twisted, causing the cord to stretch and become tight around the gap between the lid and container and slip into the gap. As twisting continues, the cord in the gap begins to flatten out applying an equal force axially against all points of contact between itself, the lid and the container. The cord rebounds to its normal shape following separation of the lid and container.

Containers and lids having no gap for receiving the cord loop are opened using an adapter kit comprising a pair of adapter rings made of rubber, plastic or other material that slip around the lid and container neck. The adapter rings establish an artificial gap to receive the cable loop. After the container is opened, the adapter rings are removed from the lid and container.

Still other objects and advantages of the invention will become readily apparent to those skilled in this art from the following detailed description, wherein I have shown and described only the preferred embodiment of the invention, simply by way of illustration of the best mode contemplated by me of carrying out my invention. As will be realized, the invention is capable of other and different embodiments, and its several details are capable of modifications in various obvious respects, all without departing from the invention. Accordingly, the drawing and description are to be regarded as illustrative in nature, and not as restrictive.

BEST MODE FOR PRACTICING THE INVENTION

Figure 1:
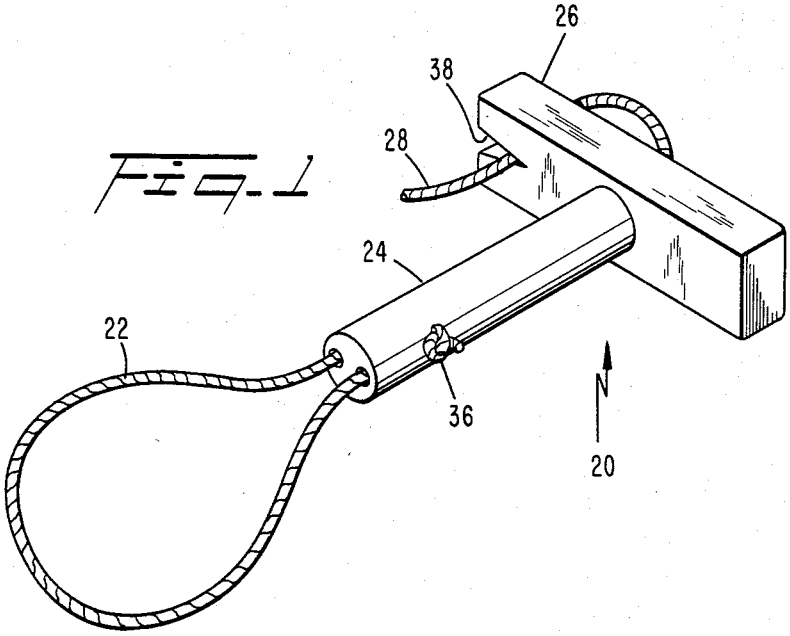
FIG. 1 is a perspective view of an apparatus for opening container lids in accordance with the invention.
Figure 2:
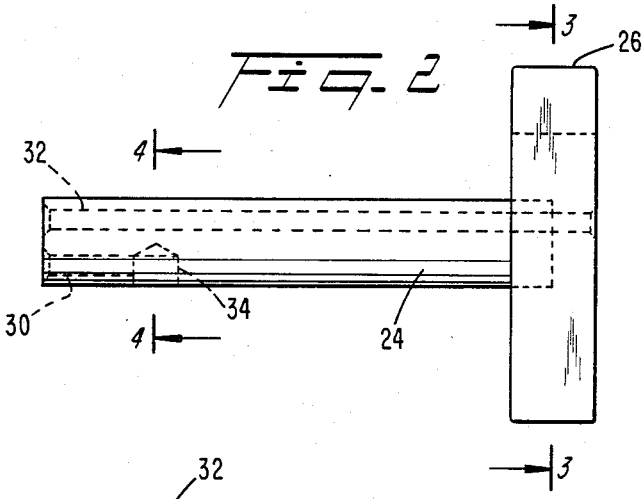
FIG. 2 is a top view of the apparatus.
Figure 3:
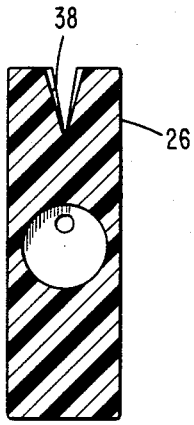
FIG. 3 is a cross-sectional view of the apparatus taken along line 3—3 in FIG. 2, showing the transverse gripper and notched end.
Figure 4:
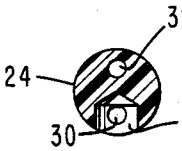
FIG. 4 is a cross-sectional view of the apparatus taken along line 4—4 in FIG. 2, showing the cylinder bore within which one end of the cord is anchored.
Figure 5:
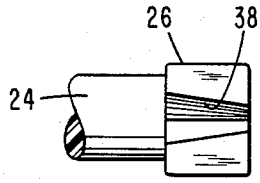
FIG. 5 is a partial side view of the apparatus, showing the notched end of the transverse gripper and a partial view of the cylinder.

Referring to FIGS. 1 and 2, an apparatus 20 for opening container lids in accordance with the invention comprises a cord 22 looped at one end of a cylindrical member 24 and at a free end 28, extending through the cylinder and a transverse gripper 26. The cylindrical member 24 is formed with first and second bores 30 and 32, respectively, parallel to each other and offset from the axis of the cylinder. Bore 30 extends partially through the cylindrical member 24, terminating at a transverse bore 34 whereas bore 32 extends completely through the cylindrical member 24 as well as through gripper 26.

Cord 22 is preferably made of wound nylon or other material having a "rebound" characteristic, that is, one wherein the diameter of the cord is reduced as the cored is stretched and rebounds as the cord is released. One end of the cord at 36 is anchored to the side of cylindrical member 24 by a knot or other means.

One end of gripper 26 is provided with a tapered notch 38 that receives the free end 28 of cord 22, as shown in FIG. 1.

The cylindrical member 24 and gripper 26 are preferablly constructed of polyvinyl chloride plastic or other suitable material. The size of the apparatus 20 depends upon particular applications.

Figure 6:
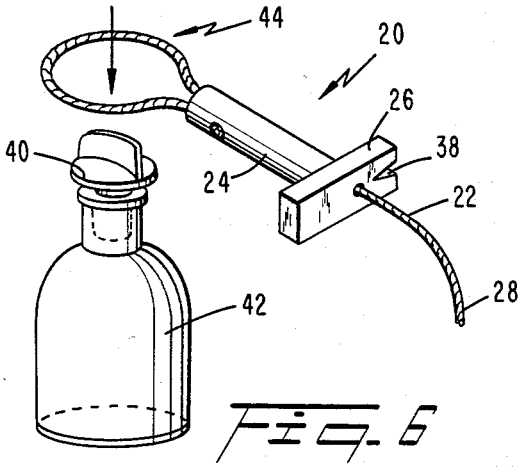
FIGS. 6–9 show a method for opening container lids using the device shown in FIGS. 1–5.
Figure 7:
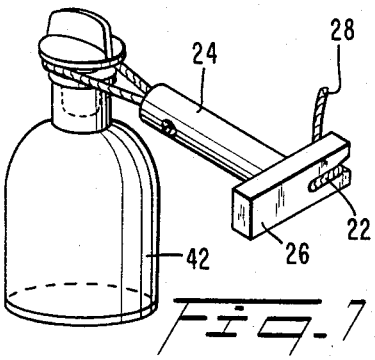

The operation of apparatus 20 is shown in FIGS. 6–9, wherein a stopper 40 is to be removed from a glass flask 42. With the free end 28 of cord 22 unseated from tapered notch 38 of gripper 26, the diameter of the cord loop at 44 is adjusted so that it is slightly larger than the diameter of the stopper 40, as shown in FIG. 6. With the loop 44 wrapped around the gap established between stopper 40 and flask 42 as shown in FIG. 7, the cord slack is such that there is a distance of approximately one and one-fourth inches between the stopper and the end of cylindrical member 24.

Figure 8:
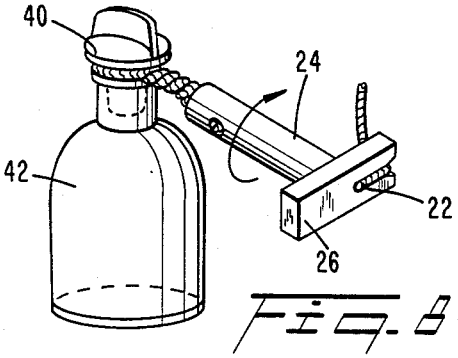
Figure 9:
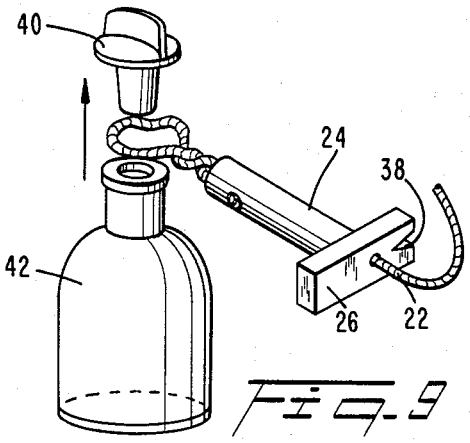

As shown in FIG. 8, the apparatus 20 is now manually twisted, causing cord 22 to twist and thereby stretch. As the diameter of the cord 22 reduces through stretching, it tends to slip within the gap between the stopper 40 and flask 42, and as the twist is further tightened, the cord tends to flatten against the neck of the stopper 40, separating the stopper 40 and flask 42 axially, as shown in FIG. 9.

Because the cord 22 applies a separation force against the surfaces of stopper 40 and flask 42 equally, no damage is imparted to the contact surfaces. Furthermore, because neither the stopper nor flask is rotated during opening, there is no danger of spillage of the contents of the flask.

Figure 10:
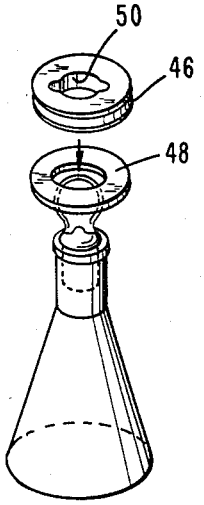
FIGS. 10 and 11 illustrate a method for opening container lids using adapter rings to form an artificial gap for receiving the cord loop.
Figure 11:
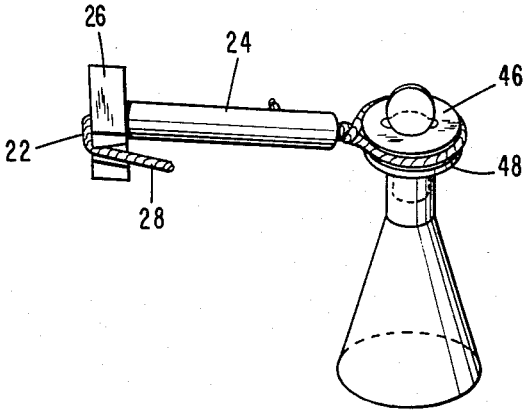

With reference to FIGS. 10 and 11, adapter rings 46 and 48, formed preferably of rubber or similar material, are positioned respectively on the stopper 40 and flask 42 to create a "gap" for receiving the cord loop 44 (FIG. 11) where one is not provided by the structures of the stopper and flask. Initially, adapter ring 48 is positioned on the neck of flask 42. The upper adapter ring 46, having an elongated opening 50, is now positioned on the stopper 40 just above ring 48 to establish a gap having a length that is slightly smaller than the diameter of the cord 22 when relaxed. To help secure the ring 46 to the stopper 40, the ring is given a one-quarter (90 deg.) turn on the stopper to position the elongated opening 50 such that it will not lift over the flat elongated stopper head or top. The cord loop 44 is now positioned at the gap between the two adapter rings 46, 48, and is operated in the manner discussed with respect to FIGS. 6–9 to separate the stopper and flask axially. Thereafter, the adapter rings 46 and 48 are removed from the stopper and flask.

The foregoing description of the preferred embodiment of the invention has been presented for purposes of illustration and description. It is not intended to be exhaustive or to limit the invention to the precise form disclosed, and obviously many modifications and verifications are possible in light of the above disclosure. The embodiment was chosen and described to best explain the principles of the invention in this particular application to thereby enable others skilled in the art to best utilize the invention in various embodiments and with various modifications as are suited to the particular use contemplated. It is intended that the scope of the invention be defined by the claims appended hereto.

I claim:

1. Apparatus for opening containers, comprising:
   - a cord having a diameter which reduces as the cord is stretched and rebounds as the cord is released;
   - an elongated member formed with first and second longitudinal bores for receiving said cord; and first and second longitudinal bores being parallel to each other and offset from the center of said elongated member;
   - a portion of said cord forming a loop at one end of said elongated member with the ends of the cord extending respectively through the first and second bores;
   - one end of said cord anchored to said elongated member; the opposite end of said cord extending through said elongated member and a gripper and forming a free end; and
   - said gripper being attached to said elongated member;
   - said gripper further being formed with a notch for receiving the free end of said cord.

2. The apparatus of claim 1, including a third bore formed in a wall of said elongated member and intersecting said second bore, said cord knotted at said third bore to anchor said cord.

3. The apparatus of claim 1, including a pair of adaptor rings adapted to mount over a container neck and over a rimless container lid to form a gap for receiving said cord.

4. A method of opening containers, comprising the steps of winding around a gap formed between a lid and the container a cord having a diameter which reduces when the cord is stretched and rebounds when the cord is released, the cord having an initial diameter that is slightly greater than the length of the gap;
   - stretching the cord so that its diameter reduces and the cord slips into the gap between the lid and container; and
   - tightening the cord within the gap to cause the cord to flatten against the lid and thereby impart an axial separating force to the lid and container.

5. The method of claim 4, wherein the stretching step includes twisting together opposite ends of the cord at the neck of the container.

6. The method of claim 5, wherein the cover and container have structures that do not form a gap therebetween, including the step of establishing a gap between the cover and the container by positioning a pair of adapter rings respectively on the cover and container, the gap for receiving said cord being thereby provided between the two rings.

* * * * *